US008577211B2

(12) United States Patent
Lucker et al.

(10) Patent No.: US 8,577,211 B2
(45) Date of Patent: Nov. 5, 2013

(54) HEATING ELEMENT ASSEMBLY FOR ELECTRIC TANKLESS LIQUID HEATER

(75) Inventors: Brian Lucker, Wolcott, CT (US); Jeff Hankins, Southbury, CT (US)

(73) Assignee: Eemax Incorporated, Oxford, CT (US)

( * ) Notice: Subject to any disclaimer, the term of this patent is extended or adjusted under 35 U.S.C. 154(b) by 348 days.

(21) Appl. No.: 12/881,957

(22) Filed: Sep. 14, 2010

(65) Prior Publication Data

US 2012/0063755 A1 Mar. 15, 2012

(51) Int. Cl.
*A61F 7/00* (2006.01)
*F16B 21/18* (2006.01)

(52) U.S. Cl.
USPC ..... 392/470; 411/533

(58) Field of Classification Search
USPC ..... 392/470; 411/533; 151/38, 14
See application file for complete search history.

(56) References Cited

U.S. PATENT DOCUMENTS

| | | | | |
|---|---|---|---|---|
| 2,700,505 | A | 1/1955 | Jackson | |
| 3,088,017 | A | 4/1963 | Schomann | |
| 3,952,182 | A | 4/1976 | Flanders | |
| 3,968,346 | A | 7/1976 | Cooksley | |
| 4,041,275 | A | 8/1977 | Gerdes | |
| 4,095,087 | A | 6/1978 | Giraud | |
| 4,204,566 | A * | 5/1980 | Kirrish et al. | 411/324 |
| 4,410,791 | A | 10/1983 | Eastep | |
| 4,436,983 | A | 3/1984 | Solobay | |
| 4,439,669 | A | 3/1984 | Ryffel | |
| 4,567,350 | A | 1/1986 | Todd, Jr. | |
| 4,604,515 | A | 8/1986 | Davidson | |
| 4,638,147 | A | 1/1987 | Dytch et al. | |
| 4,762,980 | A * | 8/1988 | Insley | 392/494 |
| 4,900,896 | A | 2/1990 | Maus | |
| 4,960,976 | A | 10/1990 | Insley | |
| 5,020,127 | A | 5/1991 | Eddas et al. | |
| 5,129,034 | A | 7/1992 | Sydenstricker | |
| 5,216,743 | A | 6/1993 | Seitz | |
| 5,222,185 | A | 6/1993 | McCord, Jr. | |
| 5,325,822 | A | 7/1994 | Fernandez | |
| 5,332,884 | A | 7/1994 | Bailey | |
| 5,408,578 | A | 4/1995 | Bolivar | |
| 5,437,003 | A | 7/1995 | Blanco | |
| 5,438,642 | A | 8/1995 | Posen | |
| 5,440,667 | A | 8/1995 | Simpson et al. | |

(Continued)

OTHER PUBLICATIONS

The Wholesaler May 2003, Product News.

*Primary Examiner* — Sang Y Paik
*Assistant Examiner* — Renee L Miller
(74) *Attorney, Agent, or Firm* — Choate, Hall & Stewart LLP; Charles E. Lyon; Daniel S. Matthews

(57) ABSTRACT

In various aspects, the present application describes a heating element assembly for a liquid heater, embodiments of which may include an electrically conductive termination rod with a base portion defining a securement opening. An electrically conductive fastener may include a shank portion for fitting into the securement opening. The heating element assembly may have a head portion larger than the securement opening, and an electrical resistance heating element comprising a continuous coil. An end portion of the continuous coil may be formed to loop around the fastener shank portion. The end portion may be in electrical contact with the fastener head portion and the termination rod base portion. An adjacent portion of the continuous coil may be formed to clear the fastener head portion as the adjacent portion extends from the end portion. The continuous coil may have a coil axis substantially aligned with a lengthwise axis of the fastener.

20 Claims, 13 Drawing Sheets

(56) References Cited

U.S. PATENT DOCUMENTS

| | | | | |
|---|---|---|---|---|
| 5,479,558 | A | 12/1995 | White, Jr. et al. | |
| 5,504,306 | A | 4/1996 | Russell et al. | |
| 5,523,550 | A | 6/1996 | Kimura | |
| 5,573,690 | A * | 11/1996 | Nobori et al. | 219/458.1 |
| 5,724,478 | A | 3/1998 | Thweatt | |
| 5,769,033 | A | 6/1998 | Petty | |
| 6,061,499 | A | 5/2000 | Hlebovy | |
| 6,080,971 | A | 6/2000 | Seitz et al. | |
| 6,167,845 | B1 | 1/2001 | Decker, Sr. | |
| 6,240,250 | B1 | 5/2001 | Blanco | |
| 6,389,226 | B1 | 5/2002 | Neale et al. | |
| 6,539,171 | B2 | 3/2003 | VonArx et al. | |
| 6,539,173 | B2 | 3/2003 | Chu | |
| 6,574,426 | B1 | 6/2003 | Blanco, Jr. | |
| 6,640,048 | B2 | 10/2003 | Novotny et al. | |
| 6,909,843 | B1 | 6/2005 | Fabrizio | |
| 6,909,849 | B1 * | 6/2005 | Staley | 398/106 |
| 7,567,751 | B2 | 7/2009 | Fabrizio | |
| 7,779,790 | B2 | 8/2010 | Fabrizio | |
| 2001/0048811 | A1 | 12/2001 | Waithe et al. | |
| 2003/0044173 | A1 | 3/2003 | Natsuhara et al. | |
| 2003/0113107 | A1 | 6/2003 | Winter et al. | |
| 2003/0185548 | A1 | 10/2003 | Novotny et al. | |
| 2003/0206733 | A1 | 11/2003 | Hadar | |
| 2004/0151561 | A1 * | 8/2004 | Hrytzak et al. | 411/533 |
| 2009/0285569 | A1 | 11/2009 | Fabrizio | |
| 2010/0278519 | A1 | 11/2010 | Fabrizio | |
| 2011/0013893 | A1 | 1/2011 | Fabrizio | |

* cited by examiner

SECTION A-A

DETAIL B

SECTION D-D

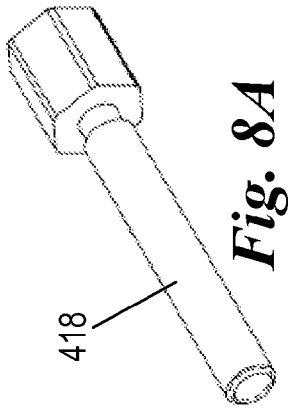
Fig. 8A
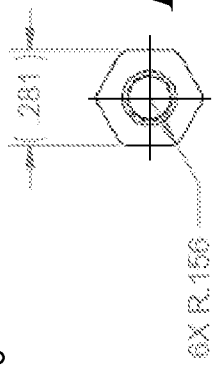
Fig. 8C
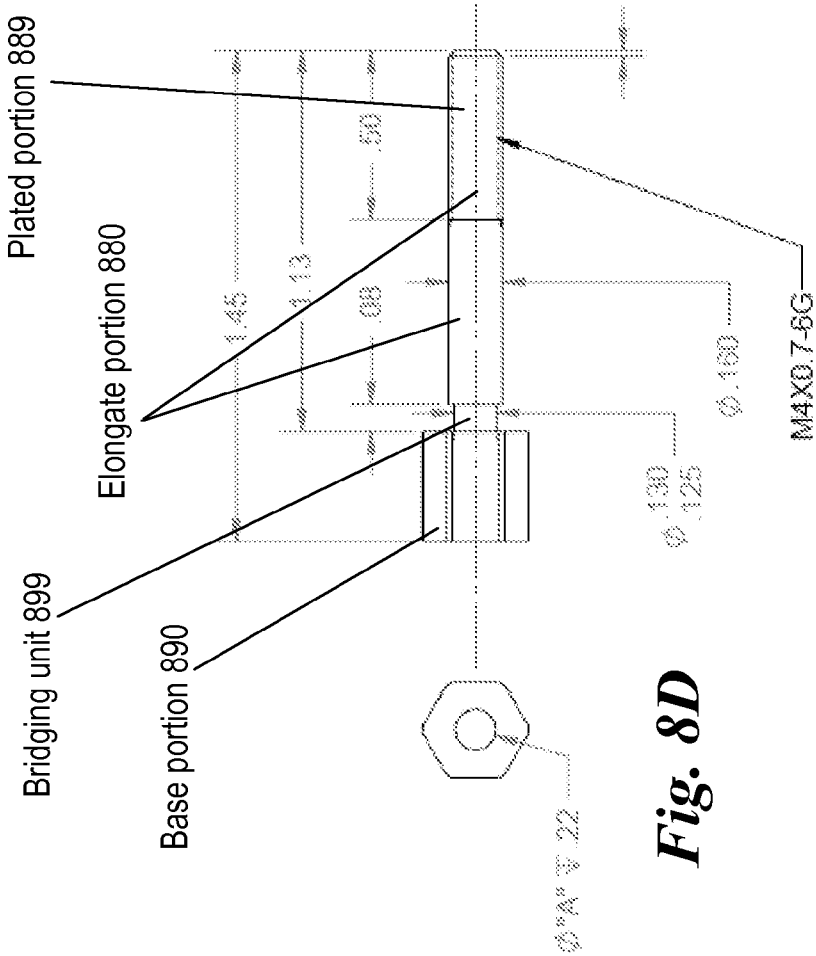
Fig. 8B
Fig. 8D

HEATING ELEMENT ASSEMBLY FOR ELECTRIC TANKLESS LIQUID HEATER

A portion of the disclosure of this patent document contains material which is subject to copyright protection. The copyright owner has no objection to the facsimile reproduction by anyone of the patent document or the patent disclosure, as it appears in the file or records of the Patent and Trademark Office, but otherwise reserves all copyright rights whatsoever.

FIELD OF THE DISCLOSURE

This disclosure generally relates to systems and methods for heating liquids. In particular, this disclosure relates to a heating element assembly for electric liquid heating systems.

BACKGROUND

The most common approach for providing hot water in both domestic and commercial settings involves the use of large tanks for the storage of hot water. Although such heated tank systems can provide hot water at a relatively high flow rate, they are inherently energy inefficient because the water in the tank is continually reheated even when water is not being used on a regular basis. Another approach to providing hot water involves the use of a tankless water heater system that heats water only when hot water is being used. Such tankless water heater systems, also referred to as demand water heater systems, can often provide a more energy efficient means of heating water than storage systems using the same type of heating (e.g., gas, electric, etc.).

Tankless water heaters typically use electrical resistance heating elements for heating water. These heating elements can be energized on demand and the electrical flow regulated for various applications. Electrical resistance heating elements can, however, be susceptible to failure when used over time. In some instances, an electrical resistance heating element may have a higher failure rate than some other parts of a water heater. It is therefore beneficial to improve the design, arrangement and installation of conventional electrical resistance heating elements to improve durability and/or maintain performance levels of the heating elements.

SUMMARY OF THE DISCLOSURE

The present application relates to electric tankless liquid heater systems, and in particular, to a heating element assembly for a liquid heater. In various aspects, the present disclosure describes embodiments of a heating element assembly that is removable and/or replaceable from a liquid heater. The heating element assembly may be designed and constructed for durability and robustness under various operating conditions, and/or to minimize the overall cost and maintenance of the liquid heater. In certain embodiments, the heating element assembly may be designed to improve electrical contact at various connection points between components of the heating element assembly. Improved electrical contact at a connection point may improve performance and/or reduce vulnerability to failure in the locality of the connection point. The heating element assembly may further be designed and constructed to minimize mechanical stress in the structure and/or arrangement of the components. Mechanical stress, for example characterized by the permanent or temporary stretching, twisting and/or bending of a portion of a heating element, may make the mechanically-stressed portion vulnerable to failure under certain operating conditions.

In one aspect, the present invention is related to a heating element assembly for a liquid heater. The heating element assembly may include an electrically conductive termination rod with a base portion defining a securement opening. In certain embodiments, the heating element assembly includes an electrically conductive fastener comprising a shank portion for fitting into the securement opening of the termination rod. The heating element assembly may include a head portion having at least one dimension larger than a respective dimension of the securement opening. The heating element assembly may further include an electrical resistance heating element comprising a continuous coil having an end portion and an adjacent portion. The end portion of the continuous coil may be formed to substantially loop around the shank portion of the fastener. The end portion may be in electrical contact with the head portion of the fastener and the base portion of the termination rod when fastened to the termination rod. In some embodiments, the adjacent portion of the continuous coil is formed to substantially clear the fastener head portion as the adjacent portion extends from the end portion. The continuous coil may have a coil axis substantially aligned with a lengthwise axis of the fastener.

In some embodiments, a section of the adjacent portion of the continuous coil is formed to at least partially loop around and provide electrical contact with a portion of the head portion of the fastener. A section of the adjacent portion of the continuous coil may be formed to provide at least a partial loop around the shank portion of the fastener. In certain embodiments, the adjacent portion of the continuous coil is formed with minimal mechanical stress. The end portion of the continuous coil may be in electrical contact with both the shank and head portion of the fastener, and the base portion of the termination rod when fastened to the termination rod. The end portion of the continuous coil may be formed with minimal mechanical stress.

In some embodiments, a substantial portion of the end portion loop is in electrical contact with the termination rod. The end and adjacent portions of the continuous coil may be formed to provide maximum electrical contact with the fastener and termination rod. In certain embodiments, the continuous coil may comprise a Nickel-Chromium alloy wire. A section of the continuous coil bridging the end portion and the adjacent portion may be formed with minimal mechanical stress. In different embodiments, the fastener may comprise a stud, pin, rivet, bolt or screw. The shank and head portions of the fastener proximate to or in contact with the heating element may be formed to remove all sharp edges and burrs.

In some embodiments, the termination rod is electrically connected to a power source. In certain embodiments, the heating element is sheathless. The continuous coil may include wire having a wire diameter of about 0.003 inch to 0.125 inch. The end portion of the continuous coil may be formed with a coil axis having a radius of about 0.025 inch to 0.500 inch. The continuous coil may be rated at about 0.1 to 100 Ohms per inch. In certain embodiments, the heater element assembly is configured for minimal mechanical stress to the continuous coil when installed in a water heater. The heater element assembly may be installed in a tankless water heater. The heater element assembly may be part of a removable heater cartridge installed in a tankless water heater.

The foregoing and other aspects, embodiments, and features of the invention can be more fully understood from the following description in conjunction with the accompanying drawings. In the drawings like reference characters generally refer to like features and structural elements throughout the various figures. The drawings are not necessarily to scale, emphasis instead being placed upon illustrating the principles of the invention.

BRIEF DESCRIPTION OF THE DRAWINGS

FIG. 4A is a sectional view, FIG. 4B a side view, FIG. 4C a switching unit side, side view, and FIG. 4D a proximate end, end view of the liquid heater;

FIG. 7A is a side view, FIG. 7B is a sectional view, FIG. 7C is an expanded sectional view along an axis of the heating element assembly, FIG. 7D is a sectional view perpendicular to an axis of the heating element assembly, FIG. 7E is an oblique view, and FIG. 7F is an expanded oblique view of a portion of the heating element assembly;

FIGS. 8A-8D are various views of one embodiment of a termination rod; where FIG. 8A is an oblique view, FIG. 8B is a side view perpendicular to an axis of the termination rod, FIG. 8C is a side view looking from the elongate portion end of the termination rod, and FIG. 8D is a side view looking from the base portion end of the termination rod; FIG. 9A is an oblique view, FIGS. 9B and 9C are side views perpendicular to an axis of the electrical resistance heating element, and FIG. 9D is a sectional view perpendicular to an axis of the electrical resistance heating element.

DETAILED DESCRIPTION

This disclosure provides, in various aspects, systems for heating a liquid, such as, for example, water. The systems may be configured to deliver, in various embodiments, hot liquids, and in particular hot water of a particular temperature and/or temperature range, at a certain flow rate and/or under various demand characteristics. Accordingly, in various embodiments, the disclosure describes systems for provision of hot water to multiple water fixtures, and in particular, for example, to a group of automatic fixtures with frequent and rapid changes in hot water demand. Examples of such groups of fixtures and situations include, but are not limited to, multi-station wash basins in high traffic facilities (e.g., industrial washrooms at the end-of-shifts, washrooms in sports stadiums, etc.) and showers facilities with multiple concurrent users (e.g., locker room facilities, dorm facilities, mass decontamination situations, etc.).

Figure 1:
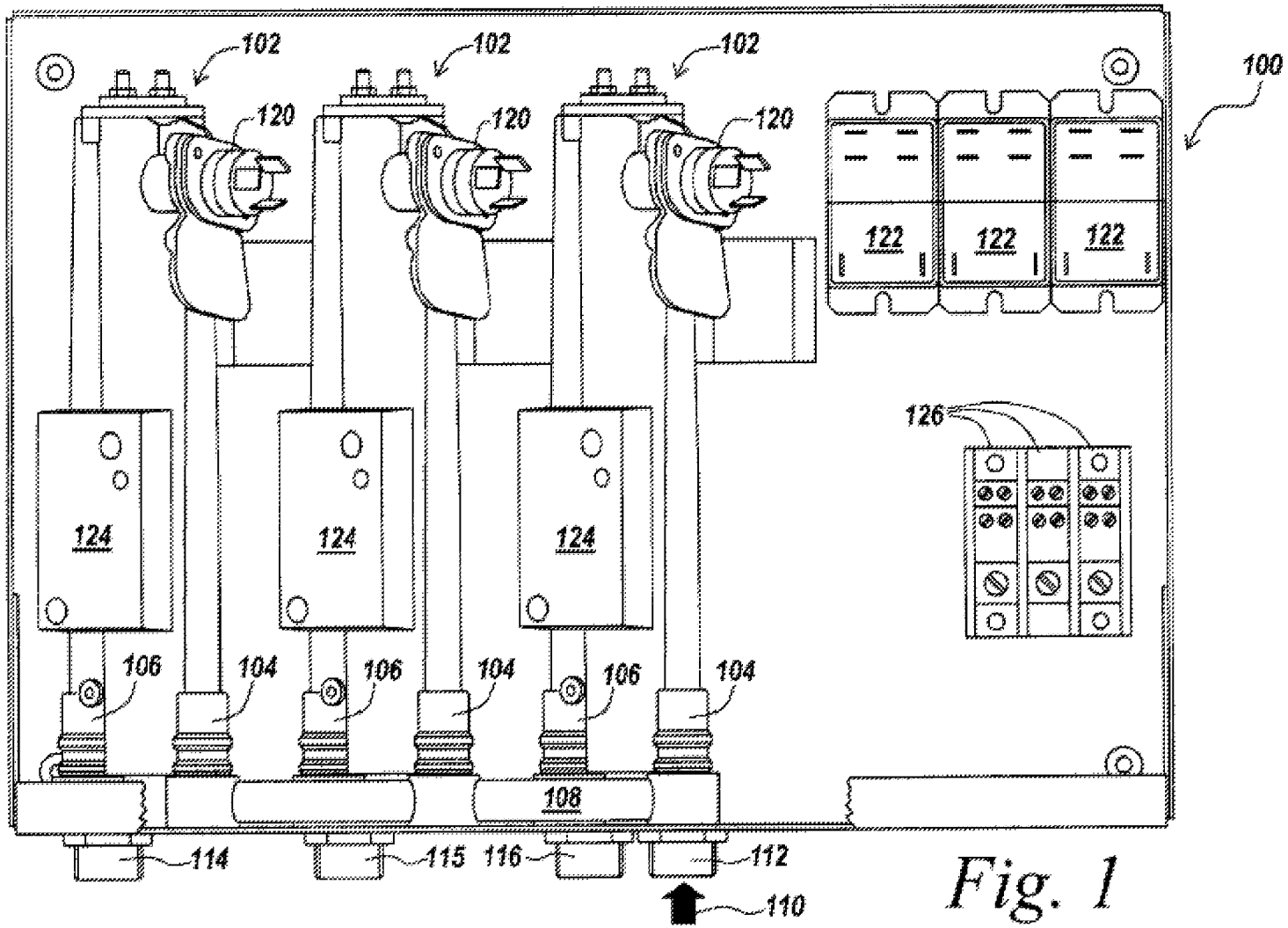
FIG. 1 is an assembly drawing illustrating various embodiments of an electric tankless liquid heater system.

Referring to FIG. 1, in various embodiments, a tankless water heater system 100 comprises a plurality of liquid heaters 102 each having a liquid inlet 104 and a liquid outlet 106. The liquid inlets 104 of the liquid heaters 102 may be connected in a parallel flow relationship by an inlet manifold 108, which in turn can be connected to a source of liquid 110 to be heated, such as, e.g., a cold water line, by an inlet manifold connection fitting 112. The liquid outlets 106 of the liquid heaters 102 may each be connected to a separate outlet conduit 114, 115, 116. Each outlet conduit can be, for example, connected to a separate fixture for the supply of hot liquid. In other embodiments, the liquid outlets 106 of the liquid heaters 102 may be connected to an outlet manifold. For example and in one embodiment, the liquid outlets 106 may be connected in a parallel flow relationship by an outlet manifold, which in turn may be connected to a hot liquid supply line by an outlet manifold connection fitting. In yet other embodiments, a tankless water heater system 100 may comprise a single liquid heater 102 connected to a source of liquid 110 to be heated.

In various embodiments, each liquid heater may include one or more electrical resistance heating elements. Electrical power to the electrical resistance heating elements may pass through a switching unit 120 and, in some embodiments, a separate circuit relay (also referred to as a contactor) 122 for each liquid heater. A controller 124, in various embodiments, mounted on the liquid heater, regulates the operation of a switching unit 120 and hence the current flow to one or more electrical resistance heaters of a liquid heater. The circuit relays 122, and therethrough one or more switching units, may be connected to a source of electrical power through taps in terminal blocks 126, which are connected to a source of electrical power (e.g., line voltage). In certain embodiments, use is also made of a ground terminal block. In some embodiments, a separate circuit relay 122 is used to energize or "arm" each switching unit and each switching unit regulates electrical current flow to the one or more electrical resistance heating elements connected thereto.

The controller may furnish an output control signal to a switching unit (such as, e.g., a bi-directional triode thyristor or "triac"), which gates power from a terminal block for selectively energizing one or more electrical resistance heating elements of a liquid heater. Solid state switching units, such as triacs, used alone can have some leakage current as they deteriorate, or if their blocking voltage rating has been exceeded. Some embodiments of the controller utilize a circuit relay installed in series with one or more switching units. In certain embodiments, the controller regulates electrical current flow to one or more electrical resistance heating elements in response to a signal produced by a temperature sensor, a flow sensor, or both. The controller may be configured to prevent energizing an electrical resistance heating element of the liquid heater until the flow rate of the liquid through the liquid inlet channel reaches or exceeds a predefined flow rate threshold. In various embodiments, the controller is configured to prevent energizing an electrical resistance heating element of the liquid heater until the flow rate reaches or exceeds a predefined value, for example, 0.3 gallons per minute (gpm), 0.5 gpm or 1 gpm. Various flow sensors may support different flow rate thresholds. In some embodiments, a flow sensor may be configurable to support a desired flow rate threshold. The liquid heater may include a temperature sensor, operably disposed in a liquid outlet channel of the liquid heater, which provides a signal to the controller for regulating electrical current flow to one or more electrical resistance heating elements and maintaining a desired output liquid temperature for the tankless liquid heater system. The tankless liquid heater and/or heating element may be designed, configured and/or constructed for heating liquid to a temperature of between about 90 degrees Fahrenheit and 200 degrees Fahrenheit. In various embodiments and application, temperature ranges may be narrower or different, e.g., 60 degrees Fahrenheit to 105 degrees Fahrenheit.

A tankless liquid heater system can be mounted in a housing comprising an enclosure containing mounting points for electrical components (for example, circuit relays, and terminal blocks) in addition to the liquid heaters. In various embodiments, the liquid heaters are mounted to the casing at an angle using angle brackets which are directly mounted to the enclosure. In one embodiment, and comprising a first plurality of three liquid heaters, the casing has the dimensions of about 15 inches wide, by about 12 inches high, by about 4 inches deep.

Figure 2:
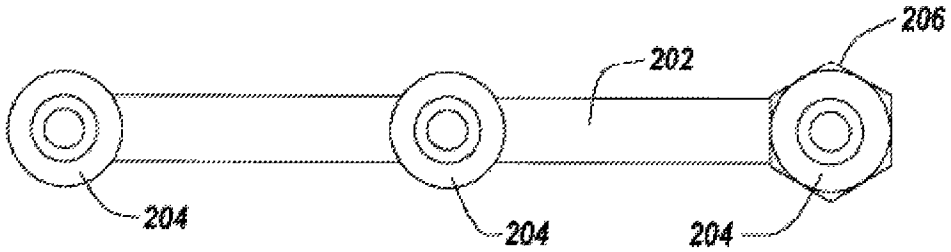
FIGS. 2 and 3 are detailed views of one embodiment of an inlet manifold.
Figure 3:
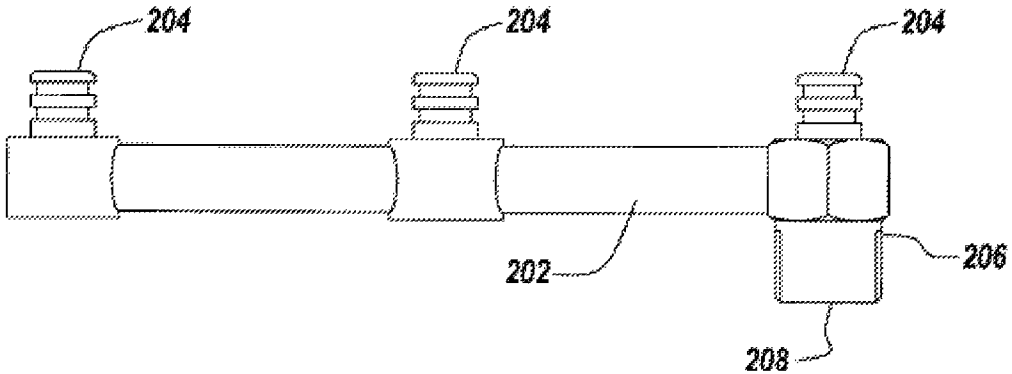

FIGS. 2 and 3 provide top (FIG. 2) and side views (FIG. 3), respectively, of one embodiment of an inlet manifold suitable for use in a tankless electric liquid heater system comprising a plurality of liquid heaters 102. In general, the inlet manifold comprises a manifold line 202 connecting, in a liquid flow relationship, heater connection fittings 204 for connecting the inlet manifold to the liquid inlets of a liquid heater. The inlet manifold further comprises a manifold connection fitting 206 (e.g., a boss having an integrally threaded portion) having an interconnection portion 208 for coupling the inlet manifold to a source of liquid.

In some embodiments, an inlet manifold comprises a manifold line of one-half inch copper tubing and each heater connection fitting comprises a brass boss having one-half inch bores and two circumferential indents each for seating an one-half inch O-ring to provide a seal against the inlet channel of a liquid heater when the liquid heater is seated thereon. The O-rings may be of buna-n-nitrile, and in some embodiments, the heater connection fittings are soldered to the manifold line. The manifold connection fitting may comprise a brass boss having a five-eighths inch bore and an interconnection portion suitable for accepting a compression fitting. In various embodiments including a coupling line, the coupling line may comprise three-quarter inch copper tubing and the coupling portion may utilize a one-inch buna-n-nitrile O-ring to circumferentially seal against the coupling line.

Figure 4A:
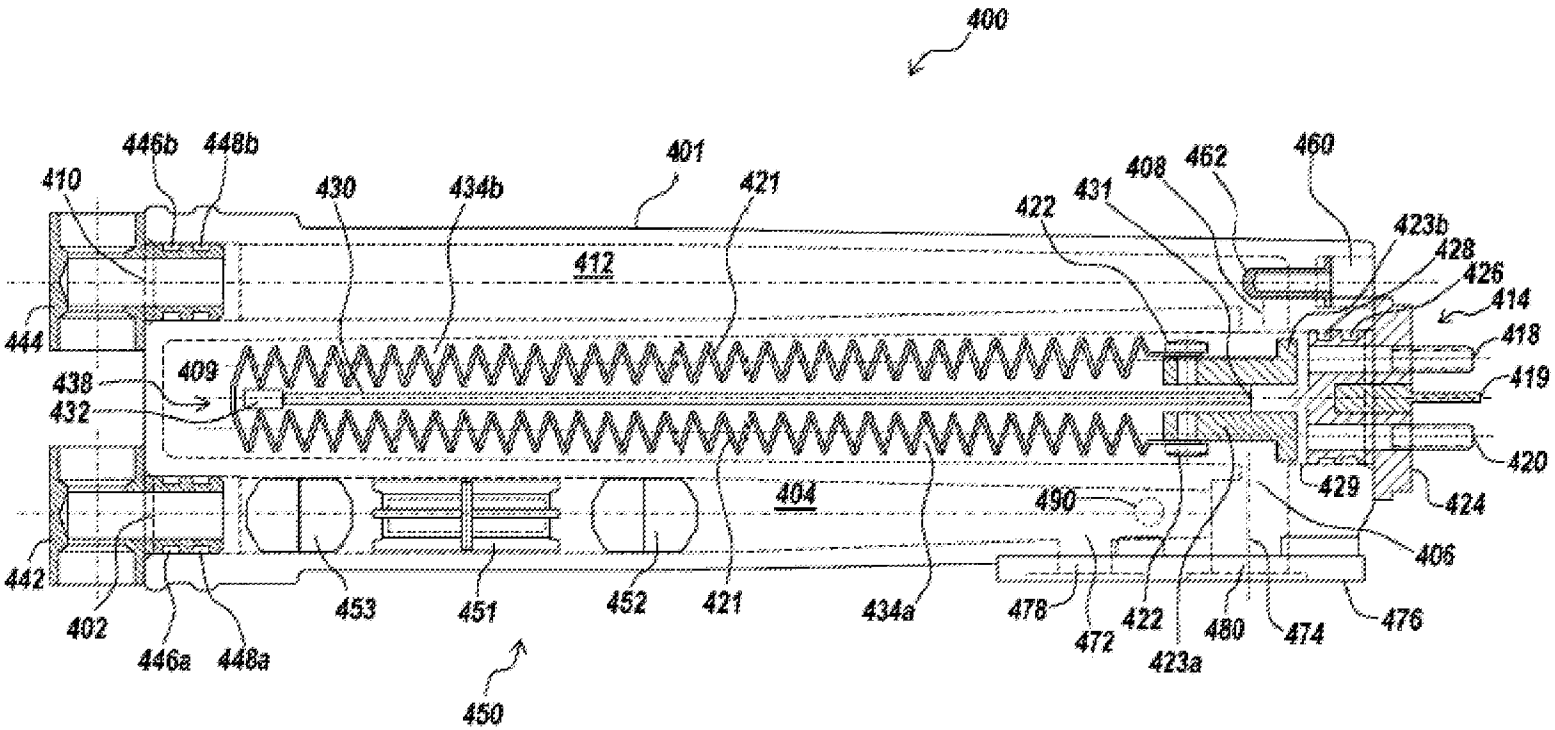
FIGS. 4A-4D are various views of one embodiment of a liquid heater for an electric tankless liquid heater system; where
Figure 4B:
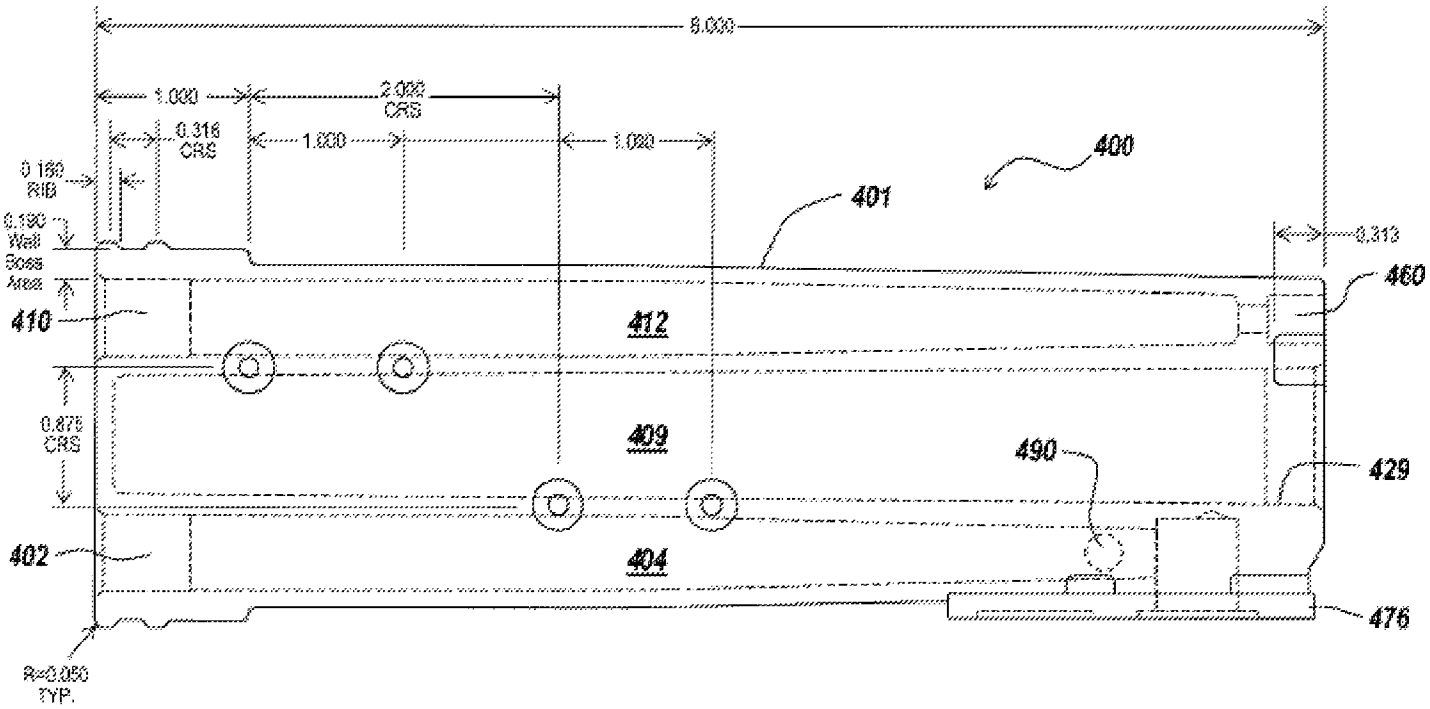
Figure 4C:
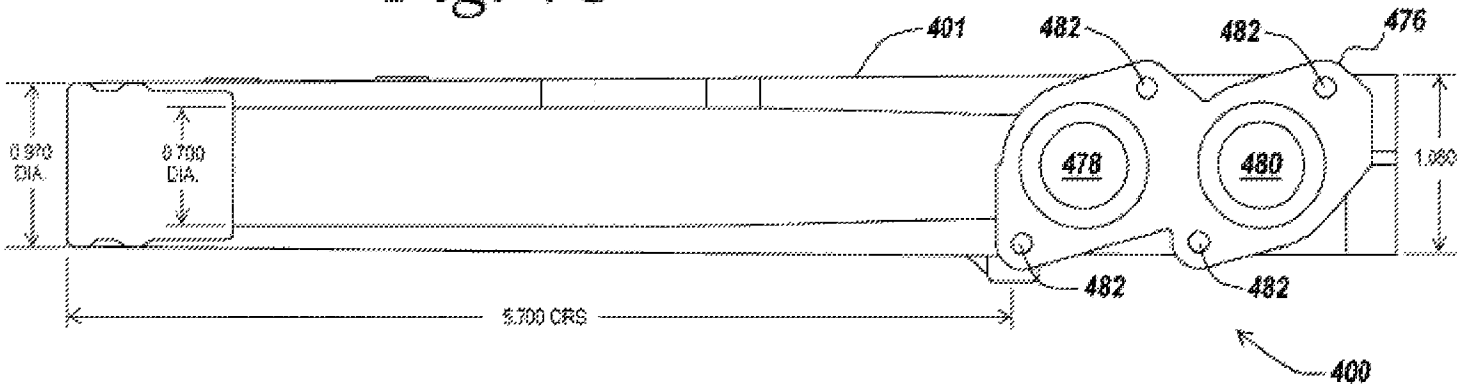
Figure 4D:
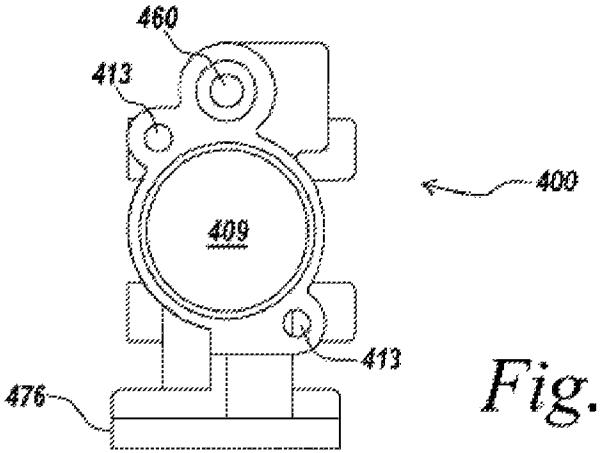

Referring to FIGS. 4A-4D, in various embodiments, a liquid heater 400 comprises a housing 401 having a liquid inlet 402, a liquid inlet channel 404 integrally including the liquid inlet 402, cross channels 406, 408 communicating with a central channel 409, a liquid outlet 410, and a liquid outlet channel 412 integrally including the liquid outlet 410. In one embodiment, the various dimensions illustrated in FIGS. 4B and 4C are in inches. The liquid heater may further comprise a heater cartridge 414, which can be fully separable from the housing 401 and capable of being removed and replaced without disconnecting the housing 401 from the inlet manifold and outlet conduits. In some embodiments, compatible heating cartridges with substantially the same or different design, configuration, materials and/or components, such as an upgraded product, may be replaced into the housing 401. The heating cartridge 414 may be releasably secured to the liquid heater housing 401 by removable fasteners inserted in securement openings 413 (e.g., passages for bolts, rivets, pins and stud, and threaded holes for screws), and it can be seen in FIGS. 1 and 4A-4D that the heater cartridge 414 can be readily released from the liquid heater without disturbing the existing mounting of the liquid heater and its plumbing connections to the inlet manifold and outlet conduits or manifold.

The heater cartridge 414 may comprise termination rods 418, 420 for electrically connecting an electrical resistance heating element 421 to a switching unit. The heater cartridge 414 further include an electrically-insulative element divider 419. The electrical resistance heating element 421 may be connected by fasteners 422 (e.g., screws, studs, pins, rivets or bolts) to members 423*a*, 423*b*, which are connected to their respective termination rods and which provide a flat surface portion for better securement against the member and better electrical contact between the electrical resistance heating element 421 and the member than a curved surface. An end portion of the heating element 421 may form at least a partial loop or hook around a respective fastener 422. In some embodiments, the members 423*a*, 423*b* are a portion of, or integrated with, the respective termination rods. The termination rods 418, 420 may be supported by a heater cartridge head 424 having head portion indents 426, 428 for seating O-rings, which become radially compressed and seal the cartridge head 424 against the walls of the central channel at the proximate end 429 of the housing 401 when the heater cartridge 414 is inserted into the central channel 409. In some embodiments, the heater cartridge head 424 may additionally or alternatively comprise screw threads or other fastening and/or sealing means for fitting against the walls of the central channel at the proximate end 429 of the housing 401 when the heater cartridge 414 is inserted into the central channel 409.

The heater cartridge 414 may further comprise a separator 430 having a proximate end 431 connected to the cartridge head 424. In some embodiments, the separator 430 is connected to an electrically conductive member 432 at the distal end. The separator 430 may comprise an electrically-insulating structure or web. The separator 430 may be part of, or integrated with the heater cartridge head 424. In some embodiments, the separator 430 and/or the electrically conductive member 432 define in the central channel 409 successive first and second interior channels 434*a*, 434*b* in fluid communication, respectively, with the liquid inlet channel 404 and the liquid outlet channel 412. In other embodiments, the separator 430 and/or the electrically conductive member 432 define in the central channel 409 an interior channel for communicating fluid between the liquid inlet channel 404 and the liquid outlet channel 412. In yet other embodiments, the heater cartridge 414 may comprise a separator 430 with one or more electrically conductive members 432 defining in the central channel 409 more than two successive interior channels in fluid communication between the liquid inlet channel 404 and the liquid outlet channel 412.

In various embodiments and in accordance with the shape and/or number of channels defined between the liquid inlet channel 404 and the liquid outlet channel 412, the electrical resistance heating element 421 may be arranged in various configurations, such as in a generally V-shaped or W-shaped configuration. In certain embodiments, the electrical resistance heating element 421 is arranged in a generally U-shaped configuration, bridging about the distal end of the separator 430. Such bridging, by a portion of the electrical resistance-heating element may place this portion 438 under mechanical stress and define a mechanically stressed portion 438 of the electrical resistance heating element 421. One or more electrically conductive members 432 may be disposed on the separator 430 (e.g., on the distal end). Each electrically conductive member 432 may be in electrical contact with at least a portion of the electrical resistance heating element preceding and with a portion following the mechanically stressed portion 438 to shunt current flow across the electrically conductive member 432. The shunting of current flow may substantially eliminate the electrical current flow through the mechanically stressed portion 438. The shunting of current flow may substantially eliminate or reduce damage or failure at or near the mechanically stressed portion 438.

Each of the electrical resistance heating elements may comprise at least one continuous, sheathless, coils. In some embodiments, the electrical resistance heating elements may comprise continuous, sheathed or partially sheathed, coils. In some embodiments, suitable electrical resistance heating elements materials include, but are not limited to, nickel-chromium alloys, and iron-chromium-aluminum alloys. Examples of suitable commercially available wire for utilization in electrical resistance heating elements can include NIKROTHAL 80 PLUS (an 80/20 NiCr alloy wire manufactured by Kanthal International, Hallstahammar, Sweden and available from Kanthal, Bethel, Conn., USA), NICR-A (an 80/20 NiCr alloy wire manufactured by National Element Inc., North Carolina, USA), KANTHAL-D (a FeCrAl alloy wire manufactured by Kanthal), and FECRAL815 (a FeCrAl alloy wire manufactured by National). In certain applications, suitable wire B&S gauges may range from about 20 (about 0.0320 inch diameter wire) to about 25 (about 0.0179 inch diameter wire) depending on the wire material, operating voltage, current and power. In some other applications, suitable wire diameters may include 0.016 and 0.028 inch. However, various liquid heater systems may use coils having a wire diameter between a range of about 0.003 inch to 0.125 inch for various applications.

In specific applications, the desired power dissipation of an electrical resistance heating element can vary from about 2.4 to 4.2 kilowatts (kW), for, for example, input flow rates between about 0.3 gpm to about 1 gpm. In various other implementations, power dissipation of an electrical resistance heating element may vary from about 1.8 to 12 kilowatts (kW), but not limited to this range. In various applications, the material and/or wire diameter of an electrical resistance heating element may be selected to maintain a safe and/or sustainable "watt-density" (e.g., watts per inch squared) during operation and facilitates maintaining a constant range of power per surface area during operation. A portion of the electrical resistance heating element may be damaged, worn, warped, overheat, conductively-weakened, or otherwise stressed temporarily or permanently if the "watt-density" and/or local temperature exceed safe and/or sustainable values. A mechanically-stressed portion of the electrical resistance heating element may be susceptible to damage, for example, as a result of electromigration and/or repeated expansion and contraction from heating cycles. A mechanically-stressed portion of the electrical resistance heating element may also be susceptible to being worn, warped, overheated, conductively-weakened, or otherwise stressed, temporarily or permanently. In some embodiments, a mechanically-stressed portion is more susceptible than another portion of the electrical resistance heating element to one or more of these effects.

Various examples of water temperature rises provided by various embodiments of the tankless liquid heater substantially similar to those illustrated in FIGS. 1-3 using liquid heaters substantially similar to that of FIGS. 4A-4D, for various values of electrical resistance heating element and operational parameters, are listed in Tables 1 below.

TABLE 1

| Voltage (volts) | Total Amps | Total kW | kW each heater | Temperature Rise ° F. at 0.5 gpm (each heater) |
|---|---|---|---|---|
| 208 | 46 | 9.6 | 3.2 | 44 |
| 240 | 46 | 11.0 | 3.67 | 50 |
| 277 | 46 | 12.6 | 4.2 | 57 |

Table 2 below lists examples of water temperature rises provided by various embodiments of the tankless liquid heater similar to those illustrated in FIGS. 1-3 which have only two liquid heaters ("a two-outlet conduit design") substantially similar to that of FIGS. 4A-4D, for various values of electrical resistance heating element and operational parameters.

TABLE 2

| Voltage (volts) | Total Amps | Total kW | kW each heater | Temperature Rise ° F. at 0.5 gpm (each heater) |
|---|---|---|---|---|
| 208 | 31 | 6.4 | 3.2 | 44 |
| 240 | 31 | 7.3 | 3.67 | 50 |
| 277 | 31 | 8.4 | 4.2 | 57 |

Referring again to FIGS. 4A-4D, in some embodiments, the liquid inlet 402 of a liquid heater is connected to an inlet manifold by inlet heater connection fitting 442, and the liquid outlet 410 of a liquid heater is connected to an outlet conduit by an outlet heater connection fitting 444. The heater connection fittings may have indents 446*a*, 446*b*, 448*a*, 448*b* for seating O-rings, which upon insertion of the heater connection fittings into the liquid inlet 402 and liquid outlet 410, become radially compressed and seal, respectively, the inlet heater connection fitting 442 in the liquid inlet channel 404 and the outlet heater connection fitting 444 in the liquid outlet channel 412.

In certain embodiments, the liquid heater 400 includes a flow sensor 450 operably disposed in the liquid inlet channel 404 and responsive to the flow rate of liquid through the liquid inlet channel 404, the flow sensor 450. The flow sensor 450 may comprise a rotometer including a magnetic portion 451 slidably disposed in the liquid inlet channel 404, and travel stops 452, 453. In operation, liquid flow through the liquid inlet channel 404 of a sufficient flow rate may force the magnetic portion 451 towards the downstream travel stop 452. In certain embodiments, the controller is responsive to the position of the magnetic portion 451 within the liquid inlet channel 404. For example, in various embodiments, at sufficient liquid flow rates through the liquid inlet channel 404 the position of the magnetic portion 451 aligns with one or more magnetically activatable switches of the controller such that the magnetically activatable switches permit the energization of the electrical resistance heating element 421.

The liquid heater may include a temperature sensor, such as, for example, a thermistor. In various embodiments, the housing 401 has a temperature sensor receipt opening 460 in the proximate end of the housing for insertion of a temperature sensor 462 therein, to dispose at least a portion of the temperature sensor 462 in the liquid outlet channel 412.

In various embodiments, one or more switching units (such as, for example, triacs) may be supported on the liquid heater housing 401 and in fluid communication with the liquid inlet channel 404 to assist in preventing overheating of the switching unit. In one embodiment, the housing 401 may have side openings 472, 474 formed in a sidewall thereof and a mounting plate 476 for mounting the switching units, the mounting plate 476 having plate openings 478, 480 and bolt securement passages 482 adjacent same for securing switching units thereto.

The liquid heater may further include a pressure relief valve incorporated in the housing. Referring to FIGS. 4A-4D, in various embodiments, the pressure relief valve comprises a valve mechanism seated in a passage 490 in the housing 401, which is in fluid communication with the liquid inlet channel 404. In some embodiments, the pressure relief valve is a resettable valve mechanism having a spring-loaded brass piston and seat. In various embodiments where the housing is rated for a maximum operating pressure of 150 psi, the pressure relief valve may, for example, be set to start actuation at 170 psi.

Figure 5A:
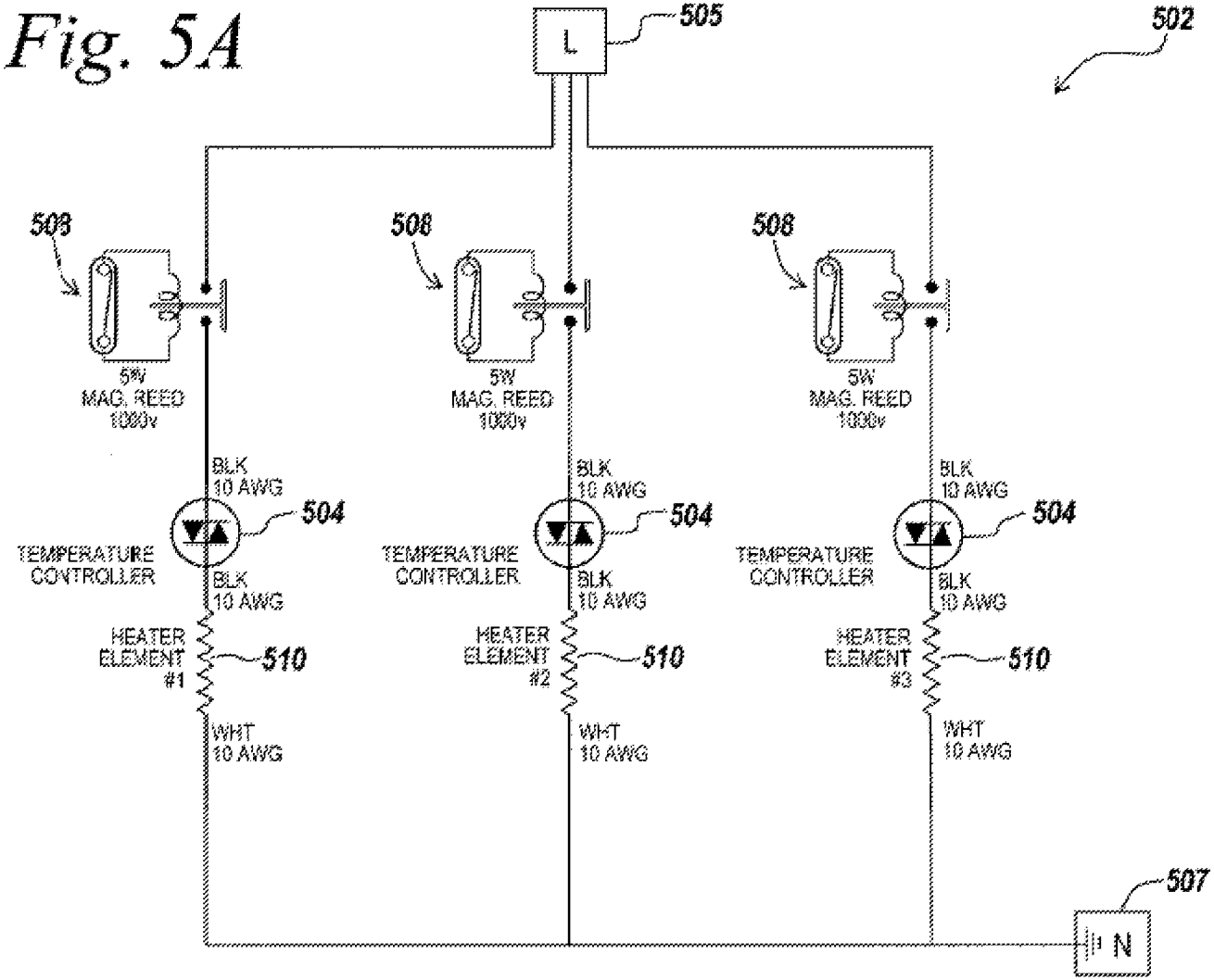
FIGS. 5A and 5B are schematic electrical diagrams of various embodiments of main electrical connection terminal for one or more switching units for an electric tankless liquid heater system.
Figure 5B:
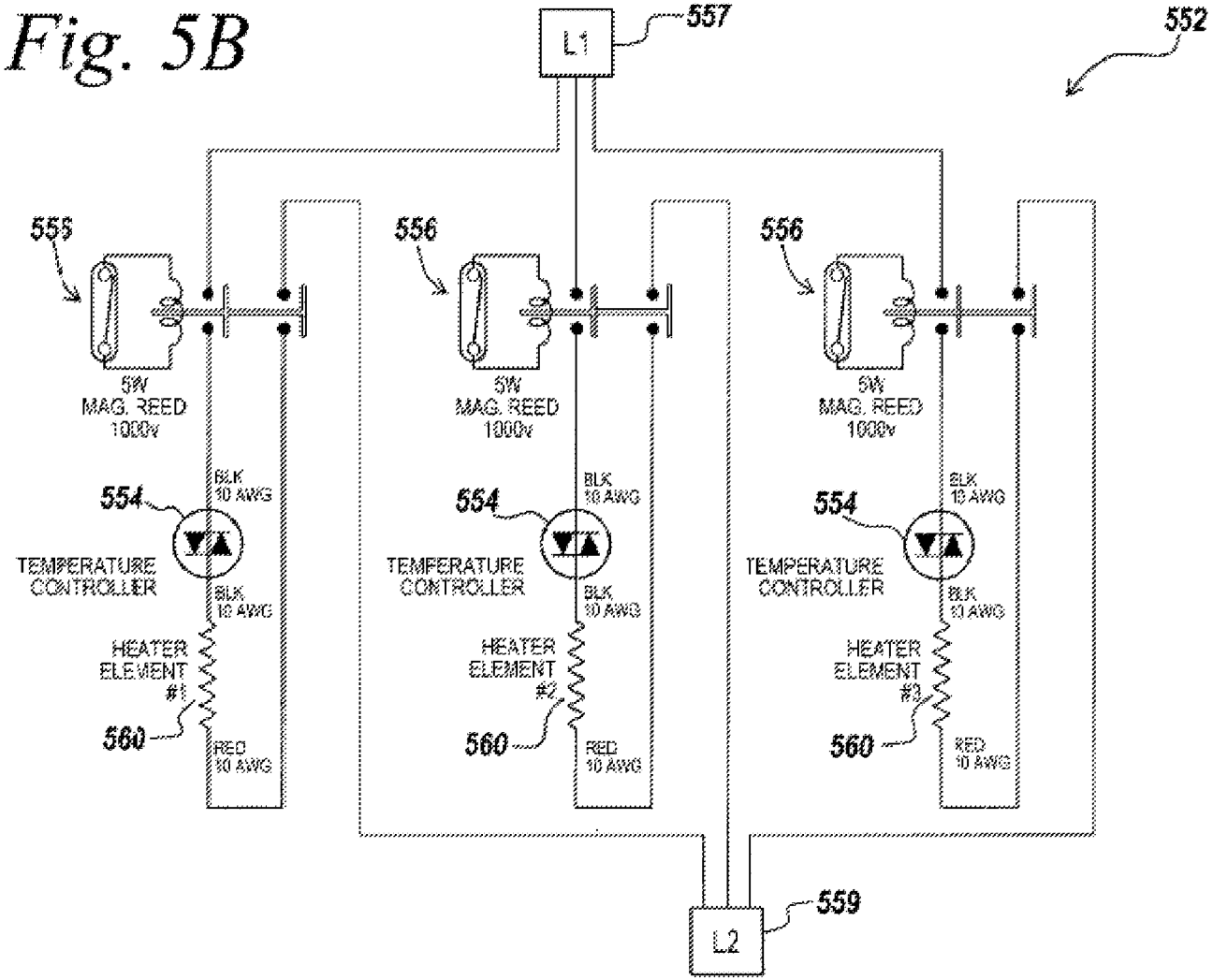

FIGS. 5A and 5B schematically illustrate various embodiments of main electrical connection for switching units in series with a circuit relay for a liquid heater system. FIG. 5A illustrates a configuration 502 for connecting a switching unit 504 (here a triac) to line voltage L, 505 and a ground N, 507. The configuration illustrated is for a typical 277 volt (V) application, although other power ratings can be supported. Each switching unit 504 may be electrically connected to line voltage L through a separate circuit relay 508 (such as, e.g., a 3 watt (W), 1000 V magnetic reed switch). The switching unit 508 may in turn be electrically connected to a respective electrical resistance heating element 510 of a liquid heater (here, one element per liquid heater) and the circuit completed by electrical connection to a ground N, 507.

FIG. 5B illustrates a configuration 552 for connecting a switching unit 554 (here a triac) in series with a circuit relay 556 to two 120 V line voltages L1, 557 and L2, 559. The configuration illustrated is for a typical 208-240 V application, although other power ratings can be supported. The switching unit 554 may be electrically connected to the first line voltage L1, 557 through a circuit relay 556 (such as, e.g., a 3 W, 1000 V magnetic reed switch). The switching unit 554 may in turn be electrically connected to a respective electrical resistance heating element 560 of a liquid heater (here, one element per liquid heater). The circuit may be completed for each electrical resistance-heating element 560 by electrical connection to the second line voltage L2, 559 through a circuit relay 556.

In certain embodiments, the tankless liquid heater includes a controller which provides thermostatic control, for example, by monitoring one or more of liquid outlet temperature, inlet flow rate, and outlet flow rate. The controller may adjust the energization of liquid heaters and the current flow to the electrical resistance heating elements to facilitate maintaining liquid outlet temperature below a maximum temperature value. In various embodiments, the maximum temperature value may be in the range between about 102° F. to about 106° F., and the maximum temperature value may be set at about 105° F., for example.

In some embodiments, The controller may adjust the energization of liquid heaters and the current flow to the electrical resistance heating elements to facilitate maintaining liquid outlet temperature within a selected temperature range. In various embodiments, the selected temperature range may be between about 100° F. to about 105° F., and in another example, the selected temperature range may be between about 104° F. to about 105° F.

The controller may regulate a circuit relay installed in series with the switching unit to, for example, increase dielectric strength and with the ability to disarm the switching unit when the flow rate, as sensed by a flow sensor, is below a predetermined threshold value.

Figure 6:
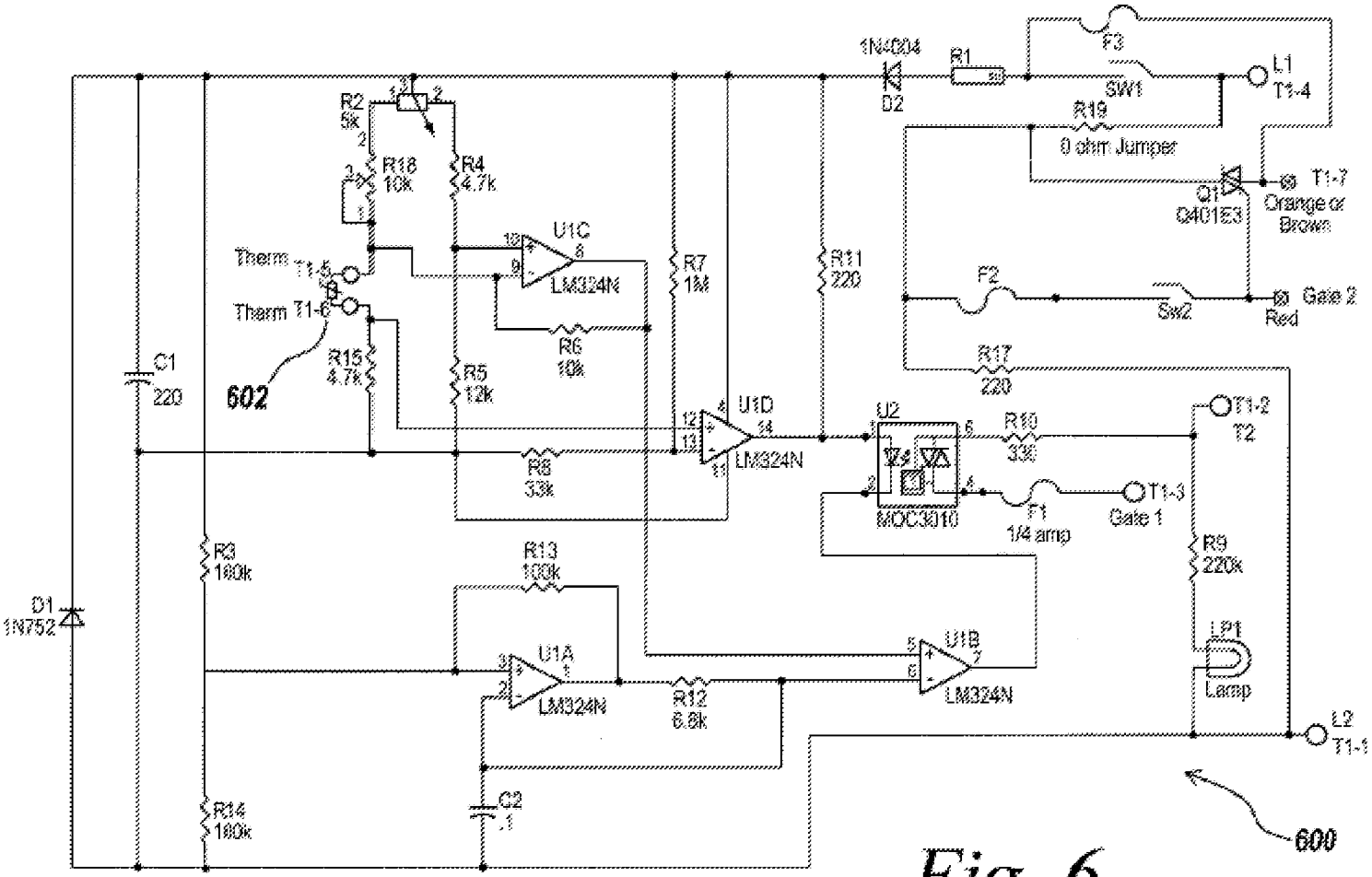
FIG. 6 is a schematic electrical circuit diagram of various embodiments of a controller for an electric tankless liquid heater system.

Referring to FIG. 6, various embodiments of a controller are illustrated. Further details of the electrical components of FIG. 6 are provided in Tables 3 and 4 for two exemplary versions. In the schematic of FIG. 6, the control circuit 600 may, in some embodiments, provide a control signal to one or more switching units on Gate 1 T1-3 and a control signal to one or more circuit relays on T1-7. It can be seen that the control signal for the one or more switching units may be regulated by a trigger device U2 (here an optical coupler) which is triggered (here the light emitting diode is driven when triggered) in response to a signal from a temperature sensor 602 (here a thermistor). The trigger device may be configured to turn the switching unit on at the zero-crossing to minimize radio frequency interference.

In operation, the temperature sensor 602 may sense the liquid temperature thereby producing a signal, which may be conditioned and amplified, and may be provided to the trigger device U2 (across pins 1 and 2 for the specific application illustrated using a MOC3010, ZCross Optocoupler from Motorola, Inc.). If the liquid temperature is adequately high for the selected temperature point (as controllably established by resistor R18), the control signal on output Gate 2 T1-3 may not cause the associated switching unit to energize the one or more electrical resistance heating elements connected thereto. In addition, if the liquid flow rate as sensed by the flow sensor is below a predetermined threshold level, the relay switches SW1 and SW2 may remain open, resulting in a control signal on T1-7 which can cause the circuit relay to remain open and may prevent current flow to the associated electrical resistance heating elements.

When the liquid temperature as sensed by the temperature sensor 602 falls below the temperature set point, the trigger device U2 may be triggered (here, e.g., the light emitting diode emits), generating a control signal on output Gate 2 T1-3 permitting the associated switching unit to energize. However, for current flow to reach the one or more electrical resistance heating elements associated with the switching unit, the liquid flow rate, as sensed by the flow sensor, must, in some embodiments, be equal to or above a predetermined threshold level to close the relay switches SW1 and SW2. This may result in a control signal on T1-7 which causes the circuit relay to close and may permit current flow to the switching unit and associated one or more electrical resistance heating elements. For example, in various embodiments where the flow sensor comprises a rotometer including a magnetic portion configured to slidably respond to the liquid flow rate through a liquid heater, liquid flow through the liquid heater of equal to or above a predetermined flow rate threshold may force the magnetic portion to slide into an alignment with the relay switches SW1 and SW2. The alignment may close the switches, and may permit the energization of the associated electrical resistance heating element. In some embodiments, the flow sensor thus provides a signal to the controller via the magnetic force exerted by the magnetic portion on the relay switches SW1 and SW2.

TABLE 3

| Element | Device | Value, Version 1 | Value, Version 2 |
|---|---|---|---|
| C1 | Capacitor | 220 ufd/10 v | 220 ufd/10 v |
| C2 | Capacitor | 0.1/50 v | 0.1/50 v |
| D1 | Zener Diode | 1N752 | 1N752 |
| D2 | Diode | 1N4004 | 1N4004 |
| F1 | MCR-Fuse | 0.25 A | 0.25 A |
| F2 | MCR-Fuse | 0.25 A | not present |
| F3 | MCR-Fuse | not present | 0.25 A |
| LP1 | Neon Lamp | 2 ml LAMP | 2 ml LAMP |
| Q1 | 1A Triac | Q4 01E3 | Q4 01E3 |
| R1 | Power Resistor | see Table 4 below | see Table 4 below |
| R2 | Potentiometer | 5k | 5k |
| R3 | Resistor 1/4W 5% | 100k | 100k |
| R4 | Resistor 1/4W 5% | 4.7k | 4.7k |
| R5 | Resistor 1/4W 5% | 12k | 12k |
| R6 | Resistor 1/4W 5% | 10k | 10k |
| R7 | Resistor 1/4W 5% | 1M | 1M |
| R8 | Resistor 1/4W 5% | 33k | 33k |
| R9 | Resistor 1/4W 5% | 220k | 220k |
| R10 | Resistor 1/4W 5% | 330 | 330 |
| R11 | Resistor 1/4W 5% | 220 | 220 |
| R12 | Resistor 1/4W 5% | 6.8k | 6.8k |
| R13 | Resistor 1/4W 5% | 100k | 100k |
| R14 | Resistor 1/4W 5% | 100k | 100k |

TABLE 3-continued

| Element | Device | Value, Version 1 | Value, Version 2 |
|---|---|---|---|
| R15 | Resistor 1/4W 5% | 4.7k | 4.7k |
| R17 | Resistor 1/4W 5% | 220- | not present |
| R18 | Potentiometer | 10k | 10k |
| R19 | Resistor 1/4W 5% | 0 ohm | 0 ohm |
| SW 1 | Reedswitch | HYR2016 | HYE2016 |
| SW2 | Reedswitch | HYR2016 | not present |
| T1 | EDS500V-06-P-M | T-Block | T-Block |
| U1 | LM324N | LM324N | LM324N |
| U2 | ZCross Optocoupler | MOC3010 | MOC3010 |

TABLE 4

| Voltage | R1 Values |
|---|---|
| 120 V | 2.4k, 5 W |
| 208-240 V | 5k, 5 W |
| 277 V | 6.2k, 5 W |

Figure 7A:
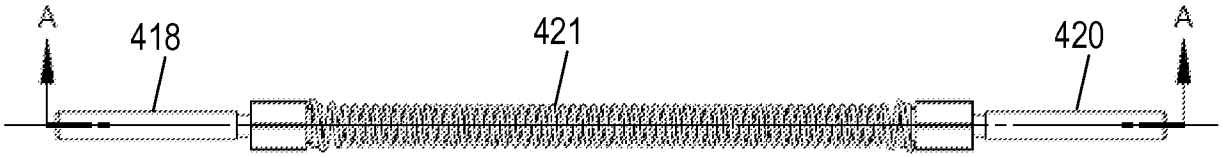
FIGS. 7A-7F are various views of one embodiment of a heating element assembly for use in an electric tankless liquid heater system; where

Referring now to FIG. 7A, one embodiment of a heating element or termination assembly (hereafter sometimes generally referred to as a "heating element assembly") for use in a liquid heater is depicted. In further details, the heating element assembly may include a pair of termination rods 418, 420, an electrical resistance heating element 421 and fasteners 422 for attaching the electrical resistance heating element 421 to the termination rods 418, 420. The electrical resistance heating element 421 may include a continuous coil. In some embodiments, the electrical resistance heating element 421 includes a plurality of coils, arranged in series or parallel configuration.

In various embodiments, the heating element assembly may be installed in a tankless liquid heater, e.g., in a liquid heating chamber or channel of the tankless liquid heater. The heating element assembly may be installed in a removable and/or replaceable heater cartridge. In some embodiments, the heating element assembly may comprise a removable and/or replaceable component of the liquid heater. In other embodiments, the heating element assembly may be sealed, partially-sealed or arranged within a compartment, unit or other portion of the liquid heater. In certain embodiments, one or more components of the heating element assembly (e.g., fastener, electrical resistance heating element) may be a removable and/or replaceable part of the heating element assembly.

The heating element assembly may be designed and constructed for durability and/or robustness under various operating conditions, and/or to minimize the cost and maintenance of the liquid heater. In certain embodiments, the heating element assembly may be designed to improve electrical contact at connection points between components of the heating element assembly. Improved electrical contact at a connection point may improve performance and/or reduce vulnerability to failure in the locality of the connection point. The heating element assembly may further be designed and constructed to minimize mechanical stress in the structure and/or arrangement of the components. Mechanical stress, such as in the stretching and/or bending of a portion of a heating element, may increase the mechanically-stressed portion's vulnerability to failure under certain operating conditions.

In some embodiments, the heating element assembly includes an electrically conductive termination rod 418, 420, such as any embodiment of termination rods described above in connection with FIG. 4A. The termination rod 418, 420 may include a base portion 890 defining a securement opening. The securement opening may provide or constitute means for attaching a heating element directly or indirectly to the termination rod 418, 420. For example and in one embodiment, the securement opening can be fitted with a fastener 422 for attaching or securing a portion of a heating element 421 to the termination rod 418, 420. In particular, FIG. 7A-7F depict various views of one embodiment of a heating element assembly using a fastener 422 to attach one end of a heating element 421 to a termination rod 418, 420. In some embodiments, the dimensions shown are in inches.

Figure 7B:
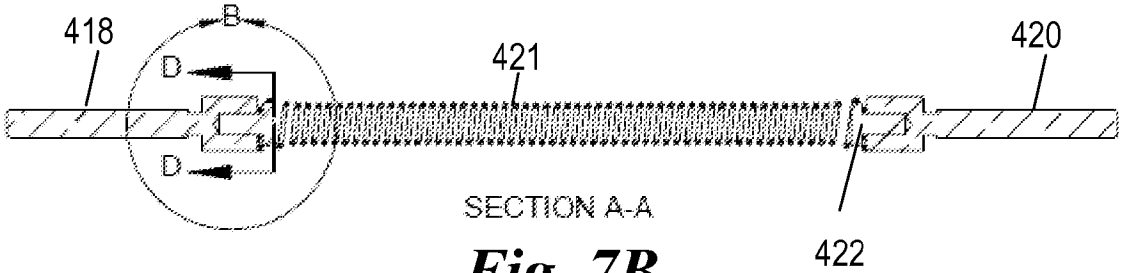
Figure 7C:
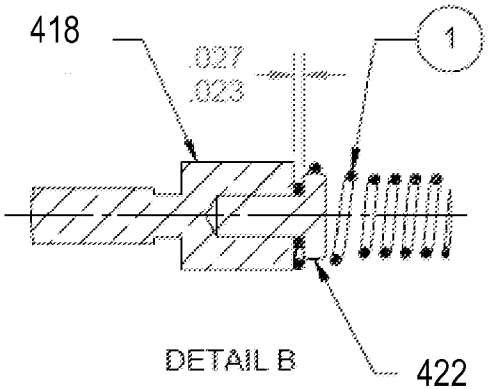
Figure 7D:
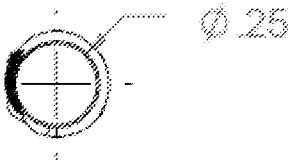
Figure 7E:
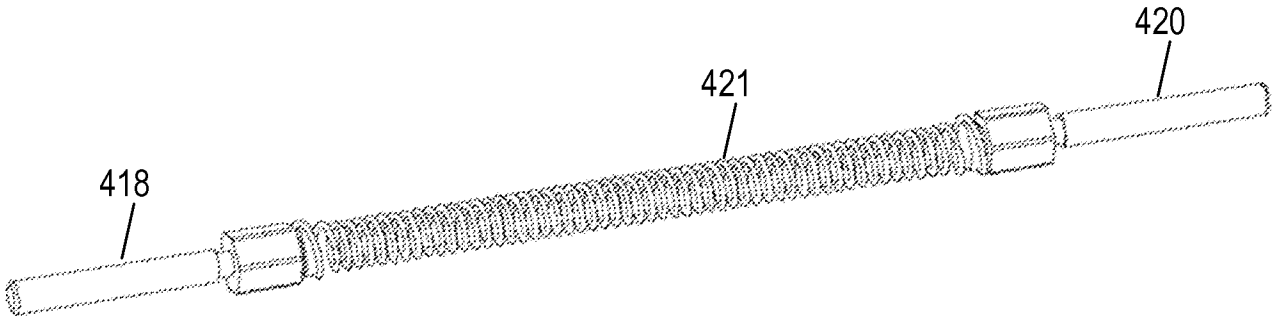
Figure 7F:
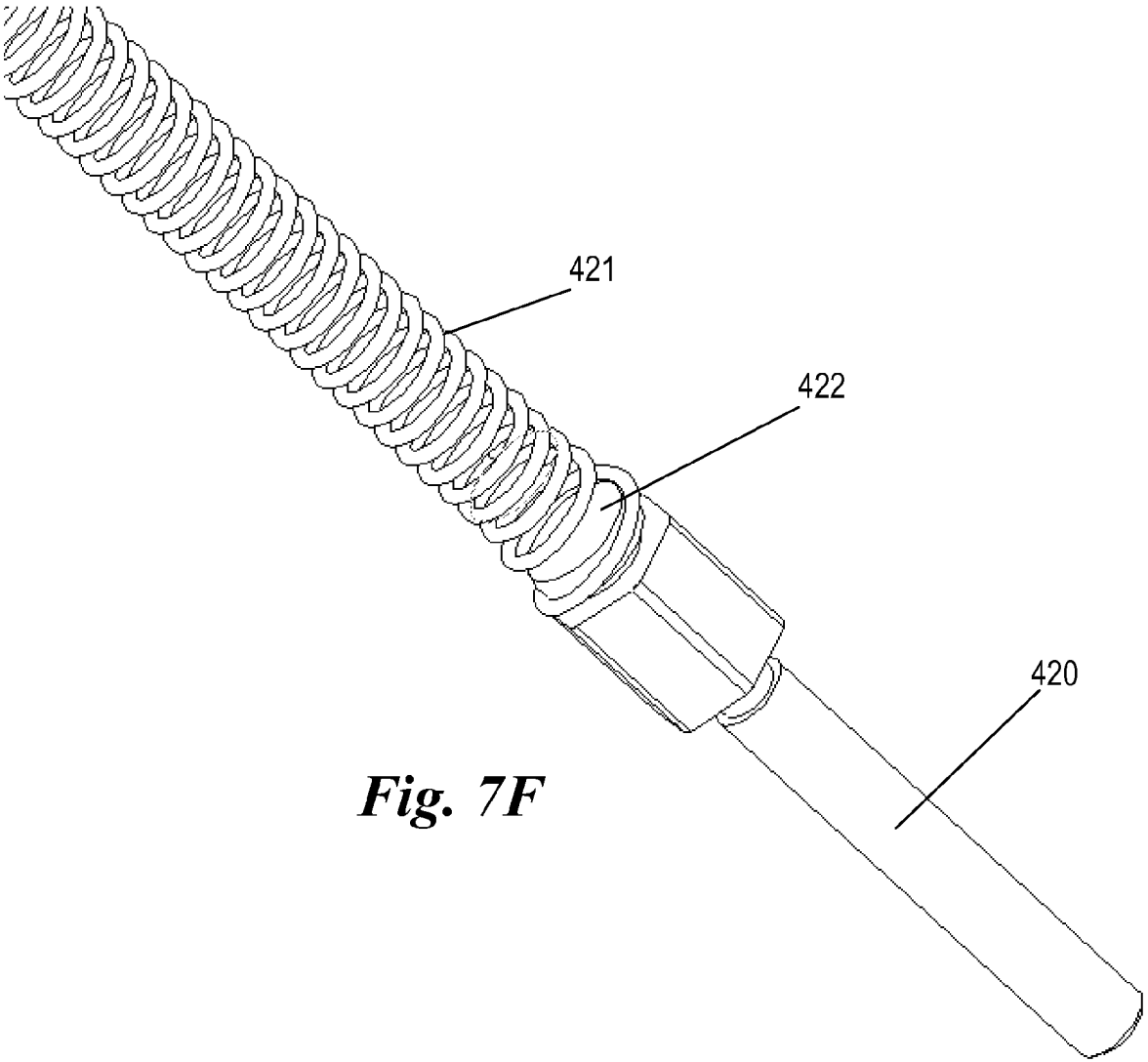

In brief overview, FIG. 7A includes a view of the heating element assembly from a direction perpendicular to the coil axis of the heating element 421. FIG. 7B includes a cross-sectional view of the heating element assembly along the A-A plane indicated in FIG. 7A. FIG. 7C includes an expanded view of a region B indicated in FIG. 7B. FIG. 7E includes an oblique view of the heating element assembly along the D-D plane indicated in FIG. 7B. FIG. 7F includes an expanded, oblique view of one end of the heating element assembly showing a fastener 422 attaching one end of a heating element 421 to a termination rod 418, 420.

A fastener 422 may attach or secure a portion of the heating element 421 to the respective termination rod 418, 420 via an interference fit. An interference fit may include using any one or more of a layer of adhesive, screw threads, ball-and-socket attachment, barbed attachment, male-and-female structures, and any attachment methods leveraging on friction. The interference fit may be supplemented by any type or form of adhesive and/or solder material. In some embodiments, the use of one or more types of interference fit, with or without adhesive or solder, may provide or ensure retention and/or continuity between the fastener 422 and a respective termination rod 418, 420.

In some embodiments, rivets or studs may be fitted or attached to termination rods in a controlled fashion. For example, rivets or studs may be fitted or attached to respective termination rods more easily and/or uniformly, e.g., during the assembling process for heating element assemblies. For example and in certain embodiments, a plurality of studs may be mechanically fitted into respective securement openings with substantially the same insertion depth, firmness, and/or pressure at contact points. Uniformity and control in fittings may result in easier inspection and/or better quality control. For example and in some embodiments, improved durability and/or predictability in the failure rate of heating element assemblies may result from heating element assemblies that are uniformly assembled. Attachments using rivets or studs may, in some embodiments, be more secure than other fasteners. Rivets or studs may be used to provide a permanent or substantially permanent attachment to termination rods.

In certain embodiments, bolts and/or screws are used as fasteners to the termination rods. Bolts and/or screws may be ore easily fitted, and in some embodiments, may be more secure than certain other means. Bolts and/or screws may be used so that a respective heating element can be removed and/or replaced.

In certain embodiments, a portion (e.g., one end) of a heating element 421 may fit directly into the securement opening defined in the base portion 890. The portion of the heating element may be directly secured to the base portion by applying any one or more of the methods described above, e.g., interference fit, solder material an/or adhesive. In some embodiments, attachment means, such as those that are magnetic (e.g., using magnets or electromagnets), utilize pressurization (e.g., vacuum, gas or liquid suction), or involve fusing materials that are in contact (e.g., welding), may help to secure the heating element 421 directly or indirectly to a termination rod 418, 420.

Referring again to FIG. 7C, and in one embodiment, the fastener 422 is secured tightly to the termination rod 418, 420. A vacuum, air or gas pocket may exist within the securement opening after the fastener 422 is fitted into the securement opening. The pocket may reside in a portion (e.g., deep end) of the securement opening carved by a drilling or forming process of the securement opening. The pocket may serve as a relief well, e.g., to contain air trapped in the securement opening when the fastener 422 is inserted. The pocket may, in some embodiments, be pressurized or vacuum-loaded. The pocket may, in certain embodiments, be defined by a tapered or conical surface of the securement opening to facilitate an interference fit.

In some embodiments, the fastener 422 is an electrically conductive fastener. The fastener 422 may include a shank portion and a head portion. The shank portion may include an elongate structure that may be parallel or tapered. The shank portion may be cylindrical or substantially cylindrical in structure. In some embodiments, the shank portion may be threaded or formed for any of the interference fit described above. In certain embodiments, the shank portion may be formed to have a dimension (e.g., cylindrical diameter) substantially the same as a respective dimension of the termination rod's securement opening. The dimension of the shank portion may be slightly smaller than the respective dimension of the securement opening. In some embodiments, the dimension of the shank portion may be the same or slightly larger than the respective dimension of the securement opening, e.g., to ensure a tight coupling. For example, the base portion 890 may be heat-expanded to allow insertion of the shank portion of the fastener 422, and then cooled to secure the fastener 422 in place.

In certain embodiments, the fastener 422 is a flat head groove or drive stud. In some embodiments, the fastener 422 is an electrical insulator, or is mildly conductive. In some of these embodiments, the fastener 422 serves to hold a portion of the electrical resistance heating element 421 directly against the respective termination rod 418, 420 for electrical contact. For example, a plastic or elastic fastener 422 may hold or press a portion of the heating element against the termination rod (e.g., as shown in FIG. 7C), while causing minimal mechanical stress on the heating element.

An electrically conductive fastener 422 may provide additional or alternative electrical conductive paths between the heating element 421 and the termination rod 418, 420. For example, the fastener 422 may provide an electrical shunt between portions of the termination rod 418, 420 and the heating element 421 to offload or supplement conduction through mechanically stressed portions of the heating element 421. The fastener 422 may provide additional conductive surfaces and/or paths to limit a local current density of a portion of the heating element. An electrically conductive fastener 422 may be surface-treated, formed, fitted and/or bonded to the securement opening for good electrical contact. The fastener 422 may also be surface-treated, formed, fitted and/or bonded to a portion of the heating element for good electrical contact.

The fastener 422 and/or base portion of the termination rod may be designed or constructed to conduct a portion of the heat away from one end of the heating element 421, e.g., as a relief against overheating on certain mechanically-stressed portions of the heating element. In certain embodiments, the fastener 422 and/or base portion 890 of the termination rod may be designed or constructed to insulate at least some heat from the heating element 421, e.g., from reaching a switch, fuse or other circuit element (e.g., elements 560, 554 and/or 556 in FIG. 5B).

The fastener 422 may include a head portion having at least one dimension larger than a respective dimension of the securement opening. The head portion may be designed or configured to hold a portion of the electrical resistance heating element 421 in place relative to a termination rod, such as in a stretched or mildly stretched arrangement. For example and in one embodiment, an end portion 990 of the heating element may hook on, or loop or partially-loop around a portion of the fastener shank. The end portion 990 may hereafter be generally referred to as a "loop", "loop portion" or "end portion loop". The diameter of the loop 990 may be smaller than a respective dimension of the head portion. At least some portion of the loop 990 may be in electrical contact with the shank and/or head portions of the fastener 422. In some embodiments, the end portion loop 990 is formed to have a diameter closely-fitting the shank portion of the fastener for good electrical contact. The loop 990 may be formed to maximize the surface area electrical contact against the head portion of the fastener. For example, a portion of the loop may be formed for contact against a flat surface of the head portion. Another portion of the heating element, such as an adjacent portion 980, extending away from loop 990 around the shank portion of the fastener 422, may be formed for contact against a curved or contoured surface of the head portion of the fastener 422. In some embodiments, the end portion loop 990 is tightly held or secured between the head portion of the fastener and the base portion of the termination rod. This end portion 990 of the heating element 421 may concurrently be in electrical contact with the head portion of the fastener and the base portion of the termination rod. In certain implementations, a portion of the loop wire may be flattened, shaved, stretched or otherwise formed for better fit and/or electrical contact with a respective fastener 422 and/or termination rod 418, 420. In certain embodiments, the loop 990 is held by the head portion of the fastener 422 near or in contact with the base portion 890 of the termination rod 418, 420. In one of these embodiments, the end portion loop 990 is not in direct electrical contact with the base portion 890 of the termination rod 418, 420. The end portion loop 990 may be in indirect electrical contact with the base portion 890 via direct contact with the fastener 422. In some embodiments, the head portion of the fastener 422 is fitted to provide a clearance of about 0.023 to 0.027 inch from a surface of the base portion 890. This clearance may be designed to cradle or position the end portion of the heating element 421, for example as shown in FIG. 7C. This clearance may be designed to minimize mechanical stress on the end portion 990 of the heating element. The wire diameter of the end portion 990 may be about 0.023 to 0.027 inch, although not limited to these dimensions.

In some embodiments, an adjacent portion 980 of the continuous coil is formed to substantially clear the fastener head portion as the adjacent portion 980 extends from the end portion 990. An adjacent portion 980 of the continuous coil may be formed to contour around the fastener head portion as the adjacent portion 980 extends from the end portion 990. Some portion of the adjacent portion 980 may be formed for electrical contact with the head portion of the fastener 422. In certain embodiments, the adjacent portion 980 may be formed to minimize or avoid contact with parts of the head portion of the fastener 422. For example and in one embodiment, an adjacent portion 980 that does not clear the head portion may cause mechanical stress, for example, due to stretching, friction or otherwise, during operation and/or installation. By way of illustration, movement and/or obstruction of the adjacent portion 980 against the head portion of the fastener 422 due to varying water flow may cause mechanical stress. Mechanically-stressed portions can be susceptible to damage or failure. Localized damage and failure in connection with mechanical stress may arise from increased physical degradation (e.g., wear and tear of moving parts), localized overheating, electro-migration and/or repeated expansion and contraction from heating cycles.

In certain embodiments, the adjacent portion 980 of the heating element 421 may be formed to balance the effects of improved electrical conduction against mechanical stress for optimal durability of the heating element assembly. Similarly, other portions of the heating element 421 may be formed and/or arranged in appropriate configurations to improve durability. For example and as discussed above in connection with FIG. 4A, the electrical resistance heating element 421 is arranged in a generally U-shaped configuration, bridging about the distal end of a separator 430. By minimizing the mechanical stress of the heating element 421 about the distal end of the separator and/or using an electrically conductive member 432 as shown in FIG. 4A, damage and/or failure of the heating element about the distal end of the separator may be reduced or avoided.

In certain embodiments, burrs and sharp edges are avoided or removed from some or all portions of the heating element assembly. For example and in one embodiment, burrs and sharp edges on the fastener 422 and/or the base portion 890 of the termination rod are removed. The shank and head portions of the fastener 422 proximate to or in contact with the heating element 421 may also be formed or machined to remove all sharp edges and burrs. Burrs and sharp edges on the fastener head portion may, for example, cause mechanical stress or wear to portions of the coil that are in contact with (e.g., move against) the head portion during heater operation.

In some embodiments, the arrangement of the heating element 421 as shown in FIG. 4A results in substantially-reduced or no mechanical stress to portions of the coil proximate to the fastener 422. In certain embodiments, however, a portion of the coil proximate to the fastener 422 may be stretched, bent, twisted or otherwise mechanically stressed relative to some other portions of the coil. For example and in one embodiment, mechanical stress from bending or stretching may result from a lengthwise axis of the coil 421 being arranged substantially perpendicular or angled relative to a lengthwise axis of the respective fastener. In certain embodiments, substantially aligning a lengthwise axis of the coil to a lengthwise axis of the respective fastener may reduce or avoid stressing portions of the coil 421 proximate to the fastener 422. One embodiment of such an arrangement is depicted in FIGS. 7A-7F.

Referring again to FIG. 7D, and in one exemplary embodiment, the diameter of the head portion of the fastener 422 is about 0.25 inch. To clear the head portion of the fastener 422, the adjacent portion 980 of the coil may be formed to have a local coil diameter greater than the diameter of the head portion of the fastener 422. In particular, FIG. 9D shows one embodiment of an end portion 990 of the coil forming a loop portion, and an adjacent portion 980. In this embodiment, the adjacent portion 980 is formed to have a local coil inner diameter of about 0.26 inch (i.e., inner radius of 0.13 inch). Accordingly, the adjacent portion 980 of the coil can clear a fastener head portion of diameter 0.25 inch. FIGS. 7C, 7E and 7F provide additional views of the adjacent portion 980 formed around the fastener head portion.

In certain embodiments, as the adjacent portion 980 extends from the end portion loop 990, the adjacent portion 980 coils around the fastener head portion. As the adjacent portion 980 extends further away from the end portion and beyond the fastener head portion, the adjacent portion 980 may extend into a main portion of the coil 421. The main portion of the coil may have a substantially uniform coil diameter. The coil diameter of the main portion may be the same or larger than that of the adjacent portion 980. In some embodiments, such as those shown in FIGS. 7A-7F and 9A-9D, the coil diameter of the main portion is smaller than that of the adjacent portion 980. The coil diameter of the main portion may be smaller than a respective dimension of the fastener head portion. This may allow a respective fastener 422 to be held or constrained in place by the end and adjacent portions, loosely or otherwise, at one end of the coil prior to attachment to a termination rod 418, 420. The fastener 422 may be held or constrained at one end of the coil due to the smaller coil diameter of the main portion of the coil.

Referring now to FIG. 8A, one embodiment of a termination rod 418, 420 is depicted. In brief overview, a termination rod 418, 420 of the heating element assembly may include a base portion 890 and an elongate portion 880. The base portion 890 and the elongate portion 880 may be aligned along an axis of the termination rod. In certain embodiments, the base portion 890 defines a securement opening for fitting with a fastener 422 and/or an end portion of a heating element 421. An axis of the securement opening may be aligned with the axis of the termination rod, for example, as shown in FIGS. 7B, 7C and 8B. In some other embodiments, the axis of the securement opening may be substantially angled or perpendicular to the axis of the termination rod 418, 420, for example, as shown in FIG. 4A.

In some embodiments, the termination rod 418, 420, including the base portion 890 and the elongate portion 880, may be directly formed as a single solid structure. e.g., machined from a single block of metallic material. In other embodiments, one or more portions of the termination rod 418, 420 may be formed separately and assembled together. For example and in one embodiment, the base portion 890 may be a brass piece. The base portion 890 may comprise a hexagonal (hex) rod piece. The elongate portion 880 may include a metallic piece that is substantially cylindrical in structure. The elongate portion 880 may comprise brass, other alloy, metal or other electrical conductor.

In some embodiments, the base portion 890 may be attached to the elongate portion via adhesive, bonding, welding, interference fit and/or using a bridging unit 899. In one example, and as described above in connection with FIG. 4A, a base portion 890, which includes the electrically conductive member 423, is attached to the respective elongate portion. In another example, a bridging unit 899 may have respective ends connecting to the base portion 890 and the elongate portion 880, via adhesive, bonding, welding, interference fit or otherwise. In one embodiment, the bridging unit 899 may have one dimension (e.g., diameter of about 0.125 to 0130 inch) smaller than a respective dimension (e.g., diameter of about 0.160 inch) of the elongate portion 880, for example, as shown in FIG. 8B. In yet another embodiment, a single metallic piece may be used to form the bridging unit 899 and the elongate portion 880.

The base portion 890 may have a dimension larger than a respective dimension (e.g., diameter of 0.160 inch) of the elongate portion 880, e.g., as shown in FIG. 8B. This dimension of the base portion 890 may be relatively larger to accommodate or define the securement opening. The dimension of the base portion 890 may be relatively larger to attach or secure the termination rod 418, 420 against the head portion of a heater cartridge, for example, illustrated in similar form in FIG. 4A. In some embodiments, the bridging unit 899 is sized or structured relative to the base and elongate portions to fit or secure the termination rod 418, 420 to the head portion of the heater cartridge.

In certain embodiments, the elongate portion 880 of the termination rod 418, 420 extends partially through the head portion of a heater cartridge. A portion of the elongate portion 880 may be exposed beyond the sealed liquid heating channels, for connection to power supply circuitry as described above in connection with FIGS. 4A, 5A and 5B. The exposed portion 889 may be plated or coated with a layer of metallic deposit, for example, to prevent corrosion and/or wear. The layer may be further treated with an anti-oxidation or anti-tarnish chemical. In some embodiments, the layer comprises nickel plating. The nickel plating may include phosphorus and/or boron content of suitable composition levels. For example and in some embodiments, the plating may comprise nickel-phosphorus or nickel-boron alloy. Electroless plating may be used. In certain embodiments, electroplating is used for depositing the metallic layer. In various embodiments, thickness of the plating may vary from about 0.0002 inch to 0.0004 inch. A lengthwise portion of the elongate portion 880, of about 0.5 inch for example, may be plated. The termination rod 418, 420 may be electrically connected, via the plated portion 889, to a power source enabled by one or more switching units or relays.

Referring to FIG. 8C, a side view of the termination rod 418, 420, as viewed from right side of FIG. 8B, is depicted. In one exemplary embodiment, the dimension of the base portion hex rod 890 across the parallel flat surfaces perpendicular to the axis of the termination rod is about 0.281 inch. The corner "radius" of the hex rod 890, as indicated, may be 0.156 inch.

Referring now to FIG. 8D, a side view of the termination rod 418, 420, as viewed from left side of FIG. 8B, is depicted. In one exemplary embodiment, the dimension of the securement opening is about 0.22 inch in diameter. In some other embodiments and implementations, exemplary values of the diameter of the securement opening include 0.096 inch, 0.104 inch or 0.120 inch, although not limited to these values.

Figure 9A:
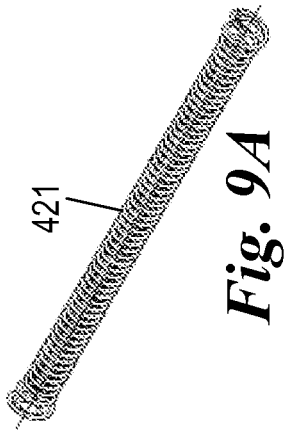
FIGS. 9A-9D are various views of one embodiment of an electrical resistance heating element; where
Figure 9B:
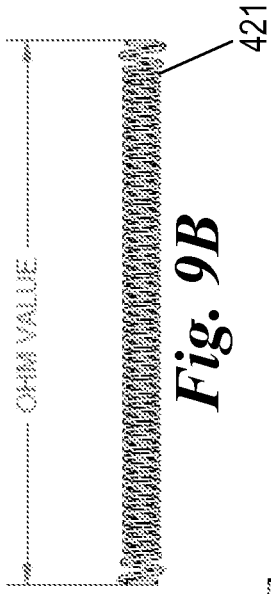
Figure 9C:
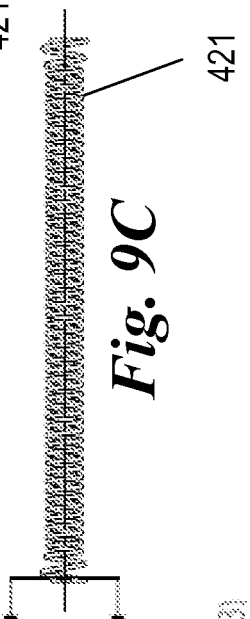
Figure 9D:
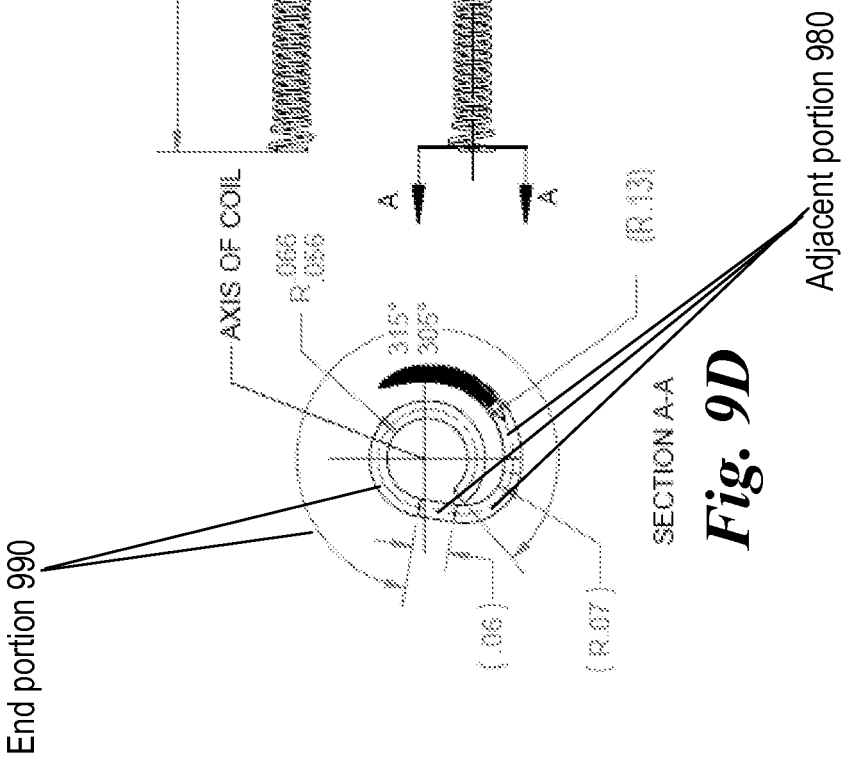

Referring to FIG. 9A, an oblique view of one embodiment of the heating element 421 is depicted. FIGS. 9B and 9C show side views of the heating element 421 perpendicular to the axis of coil. In FIG. 9C, an expanded cross-sectional view along the plane A-A indicated in FIG. 9C is depicted. In one embodiment, the end portion 990 which forms a loop around the shank portion of the fastener 422 comprises a wire loop of about 0.56 to 0.66 inch in radius. In various other embodiments, the end portion 990 of the continuous coil may be formed with a coil axis having a radius ranging from about 0.025 inch to 0.500 inch. The end portion 990 may include a partial loop of about 305 to 315 degrees, as an example. In one embodiment, the adjacent portion 980 may include a straight portion extending from the end portion, e.g., of about 0.06 inch in length. The straight portion may extend to an arc portion having a dimension of about 0.07 inch in radius. The arc portion may extend to a second arc portion (e.g., with radius of about 0.13 inch) formed around the head portion of a fastener 422.

In some embodiments, a section of the adjacent portion 980 (e.g., the straight portion and/or the first arc portion) of the continuous coil is formed to at least partially loop around and provide electrical contact with a portion of the head portion of the fastener 422. A section of the adjacent portion 980 of the continuous coil may be formed to provide at least a partial loop around the shank portion of the fastener 422. The adjacent portion 980 of the continuous coil may be formed to incorporate or result in minimal mechanical stress. For example and in one embodiment, the adjacent portion 980 may be formed to minimize bends, twists and/or kinks where mechanical stress resides. The adjacent portion 980 may be formed with fewer distinctly-structured elements, e.g., to minimize the sum of mechanical stress involved in forming these elements.

In certain embodiments, the end portion 990 of the continuous coil may be in electrical contact with both the shank and head portion of the fastener 422, and the base portion 890 of the termination rod when fastened to the termination rod 418, 420. The end portion 990 of the continuous coil may be formed to incorporate or result in minimal mechanical stress. For example, the radius of the end portion loop may be substantially the same as or close to the radius of the main portion of the coil 421, so that minimal mechanical stress may be applied to form the end portion loop 990. A substantial portion of the loop may be configured to be in electrical contact with the termination rod 418, 420.

In some embodiments, the end and adjacent portions of the continuous coil are formed to provide maximum electrical contact with the fastener 422 and termination rod 418, 420. A section of continuous coil bridging the end portion 990 and the adjacent portion 980 may be formed to incorporate or result in minimal mechanical stress. For example and in one embodiment, the section of continuous coil bridging the end portion 990 and the adjacent portion 980 may be formed to minimize bends, twists and/or kinks where mechanical stress resides. In different embodiments, various types of continuous coil may be used. These coils may be rated from about 0.1 to 100 Ohms per inch. In some embodiments, the rating of a coil is referred to as Ohm value. Ohm value may be specified in Ohms per inch or in Ohms.

In some embodiments, the end portion and/or adjacent portion may comprise a conducting segment that is attached, fused, tied, fastened, soldered, welded, crimped, or otherwise fitted to the rest of the continuous coil. For example and in one embodiment, an end portion and an adjacent portion may be a continuous wire segment that is crimped or connected to another wire segment of the coil. In certain embodiments, the end portion and/or adjacent portion may comprise a conducting segment that is braided, twisted or intertwined with another wire segment of the continuous coil. Although the end portion loop is sometimes shown in a partial loop around the shank portion of a fastener, in some embodiments, the end portion loop may comprise one or more complete and/or partial loops around the shank portion of the fastener. The end portion loop may be formed with one end twisted, braided, or intertwined with a portion of the adjacent portion or other portion of the continuous coil.

The heating element 421 may include one or more continuous coils. In some embodiments, a continuous coil comprises a continuously conducting segment or segments of wire. In certain embodiments, a continuous coil comprises one or more separate segments of wire or conductor connected in series. In one particular embodiment, a continuous coil comprises a wire segment that is formed or drawn from a single mass of conductor or metal.

The heating element assembly of the disclosure is sometimes shown, for example in FIGS. 7A, 7B and 7E, arranged in a single lengthwise axis for illustrative purposes. However, the heating element assembly may be installed or arranged differently in operation, depending on the structure and arrangement of the liquid heater. For example, in various embodiments, the heating element assembly may be arranged in a substantially or generally U-shaped configuration as described above in connection with FIG. 4A. In various embodiments, the coil of the heater element may be stretchable, twistable and/or bendable to conform to the required arrangement in the liquid heater. In certain embodiments, the coil of the heater element may be elastic. The heater element assembly, in some embodiments, is configured to incorporate or result in minimal mechanical stress to the continuous coil when installed in a water heater.

The claims should not be read as limited to the described order or elements unless stated to that effect. While the invention has been particularly shown and described with reference to specific illustrative embodiments, it should be understood that various changes in form and detail may be made without departing from the spirit and scope of the invention as defined by the appended claims. By way of example, any of the disclosed features can be combined with any of the other disclosed features to a produce an electric tankless liquid heater. Therefore, all embodiments that come within the scope and spirit of the following claims and equivalents thereto are claimed as the invention.

What is claimed is:

1. A heating element assembly for a liquid heater, comprising:

an electrically conductive termination rod with a base portion defining a securement opening;

an electrically conductive fastener comprising a shank portion for fitting into the securement opening of the termination rod, and a head portion having at least one dimension larger than a respective dimension of the securement opening, the shank portion extending away from the head portion in a first direction; and an electrical resistance heating element comprising a continuous coil having an end portion and an adjacent portion, the end portion of the continuous coil formed to substantially loop around the shank portion of the fastener, the end portion in electrical contact with the head portion of the fastener and the base portion of the termination rod when fastened to the termination rod, wherein the adjacent portion of the continuous coil is formed to substantially clear the fastener head portion as the adjacent portion extends from the end portion, the continuous coil having a coil axis substantially aligned with a lengthwise axis of the fastener, and wherein the coil longitudinally extends across the head portion and away from the head portion in a second direction that is opposite the first direction.

2. The heater element assembly of claim 1, wherein a section of the adjacent portion of the continuous coil is formed to at least partially loop around and provide electrical contact with a portion of the head portion of the fastener.

3. The heater element assembly of claim 1, wherein the end portion of the continuous coil is in electrical contact with both the shank and head portion of the fastener, and the base portion of the termination rod when fastened to the termination rod.

4. The heater element assembly of claim 1, wherein the end portion of the continuous coil is formed with minimal mechanical stress.

5. The heater element assembly of claim 1, wherein the adjacent portion of the continuous coil is formed with minimal mechanical stress.

6. The heater element assembly of claim 1, wherein a section of the adjacent portion of the continuous coil is formed to provide at least a partial loop around the shank portion of the fastener.

7. The heater element assembly of claim 6, wherein a substantial portion of the loop is in electrical contact with the termination rod.

8. The heater element assembly of claim 1, wherein the end and adjacent portions of the continuous coil are formed to provide maximum electrical contact with the fastener and termination rod.

9. The heater element assembly of claim 1, wherein the continuous coil comprises a Nickel-Chromium alloy wire.

10. The heater element assembly of claim 1, wherein a section of continuous coil bridging the end portion and the adjacent portion is formed with minimal mechanical stress.

11. The heater element assembly of claim 1, wherein the fastener comprises a stud, pin, rivet, bolt or screw.

12. The heater element assembly of claim 1, wherein the shank and head portions of the fastener proximate to or in contact with the heating element are formed to remove all sharp edges and burrs.

13. The heater element assembly of claim 1, wherein the termination rod is electrically connected to a power source.

14. The heater element assembly of claim 1, wherein the heating element is sheathless.

15. The heater element assembly of claim 1, wherein the continuous coil comprises wire having a diameter of about 0.003 inch to 0.125 inch.

16. The heater element assembly of claim 1, wherein the end portion of the continuous coil is formed with a coil axis having a radius of about 0.025 inch to 0.500 inch.

17. The heater element assembly of claim 1, wherein the continuous coil is rated at about 0.1 to 100 Ohms per inch.

18. The heater element assembly of claim 1, wherein the heater element assembly is configured for minimal mechanical stress to the continuous coil when installed in a water heater.

19. The heater element assembly of claim 1, wherein the heater element assembly is installed in a tankless water heater.

20. The heater element assembly of claim 19, wherein the heater element assembly is part of a removable heater cartridge installed in a tankless water heater.

* * * * *